US006029406A

United States Patent [19]

Staehlin

[11] Patent Number: 6,029,406

[45] Date of Patent: Feb. 29, 2000

[54] IN-FILL STADIUM SEATING

[75] Inventor: John H. Staehlin, Lutherville, Md.

[73] Assignee: Volunteers for Medical Engineering, Baltimore, Md.

[21] Appl. No.: 09/119,393

[22] Filed: Jul. 21, 1998

Related U.S. Application Data

[60] Provisional application No. 60/053,347, Jul. 22, 1997.

[51] Int. Cl.[7] ..... E04H 3/24

[52] U.S. Cl. ..... 52/9; 52/6; 52/8

[58] Field of Search ..... 52/9, 71, 6, 8

[56] References Cited

U.S. PATENT DOCUMENTS 4,580,776 4/1986 Burkinshaw ..... 52/70 X 5,050,353 9/1991 Rogers et al. ..... 52/8

*Primary Examiner*—Christopher T. Kent

*Attorney, Agent, or Firm*—Finnegan, Henderson, Farabow, Garrett & Dunner, L.L.P.

[57] ABSTRACT

The seating arrangement of the present invention comprises a series of hingedly connected rigid platforms with a series of folding seats affixed to selected platforms. Beneath each series of folding seats are a series of hingedly connected folding panels connected to front and rear support frames. When collapsing the seating arrangement for storage, the seats are folded to their closed position and the folding panels fold inwardly, pulling the front and rear frames towards each other. The folding panels may be simultaneously folded by utilizing a member connecting one or more of these folding panels. Additionally, means may be provided for facilitating the collapsing of the seating arrangement from its use position to its compact, folded configuration.

10 Claims, 6 Drawing Sheets

IN-FILL STADIUM SEATING

This application claims benefit of Provisional Application 60/053,347 filed Jul. 22, 1997.

FIELD OF THE INVENTION

This invention relates to accessible seating for persons with physical disabilities, and more particularly, to collapsible stadium seating that folds to assume a compact configuration for transportation and/or storage.

BACKGROUND OF THE INVENTION

In the majority of stadiums, predetermined seating areas are provided to accommodate individuals in wheelchairs. Generally, such space is created for these individuals by utilizing large sections of removable seating. When in use, these large sections of seats, usually at least three or four rows, are bolted down. When this area is needed for individuals in wheelchairs, this entire seating structure is removed and placed in a separate storage area. This process of unbolting and removing the entire seating section whenever space is needed, however, is very time consuming and cumbersome.

SUMMARY OF THE INVENTION

Accordingly, the present invention is directed to stadium seating that substantially obviates one or more of the problems due to limitations and disadvantages of the related art. In accordance with the purposes of the invention as embodied and broadly described herein, a seating arrangement is provided that includes rows of seats that may be compactly folded and either stowed at the predetermined section or easily transported in their compact form for storage elsewhere.

The seating arrangement comprises a series of hingedly connected rigid platforms with a series of folding seats affixed to selected platforms. Beneath each series of seats are a series of hingedly connected vertical folding panels, providing structural integrity to the seating system when the seats are occupied. When collapsing the seating arrangement for storage, the seats are folded to their closed position and the vertical folding panels are folded inwardly. To facilitate simultaneous folding, these vertical folding panels may be connected to each other by a rigid bar. Additionally, means may be provided for facilitating the collapsing of the seating arrangement from its use position to its compact, folded configuration.

DETAILED DESCRIPTION OF THE PREFERRED EMBODIMENTS

Reference will now be made in detail to the present preferred embodiments of the invention, examples of which are illustrated in the accompanying drawings.

Figure 4:
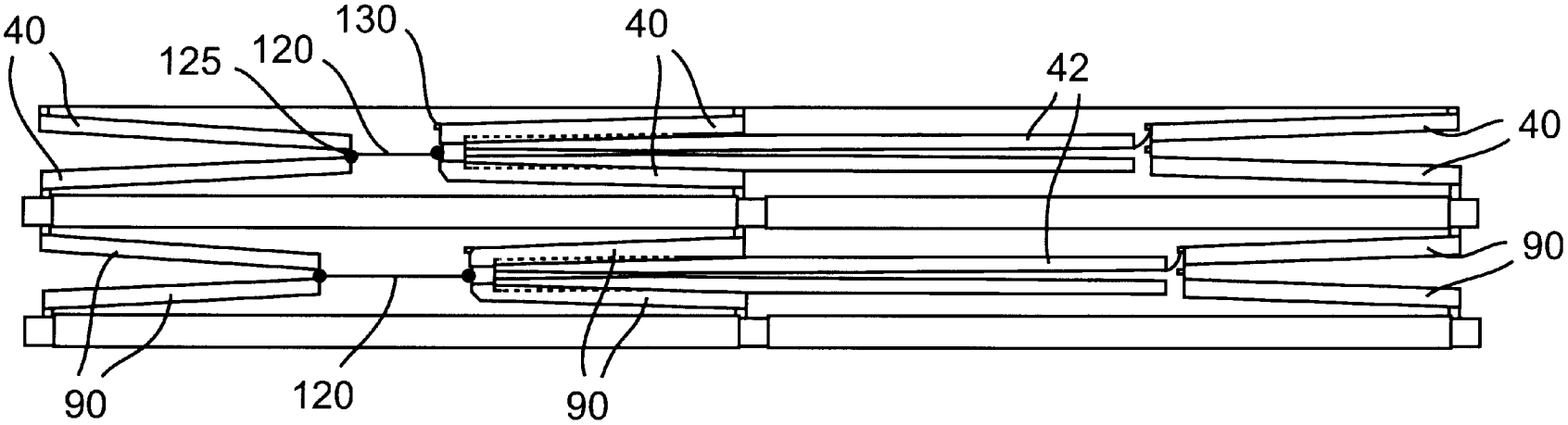
FIG. 4 is a top view of the seating system in its compact configuration.

The exemplary embodiment of the in-fill stadium seating system of the present invention is broadly embodied in FIG. I and is designated generally by reference numeral 10. As embodied herein and referring to FIG. 1, the seating system 10 is comprised of a series of hingedly connected rigid panels residing within a seating area defined by rear wall 5, front wall 6, and ground surface 7. An upper platform 20 has an upper series of folding seats 22 permanently affixed thereto. The upper platform 20 may be permanently connected to the rear wall 5 or may remain unconnected. An upper panel 30 resides in a horizontal plane substantially parallel to the upper platform 20 and is hingedly connected to the upper platform 20 at hinges 25. The upper panel 30 provides a surface for the occupant of the seat 24 to place his or her feet when the seat is in use. Residing below the upper platform 20 and the upper panel 30 are an upper series of hingedly connected vertical folding panels 40. The upper series of hingedly connected vertical panels 40 provide structural support for the upper platform 20 and the upper panel 30. One end of the upper series of hingedly connected vertical panels 40 may be connected to the rear wall 5 and the other end is connected to a rear support frame 50. As shown in FIG. 4, two of the three sets of panels in the series of hingedly connected vertical panels 40 may be connected to one another by a t-bar 42 or any similar rigid member. Of course, the series of hingedly connected upper panels 40 may be comprised of only two sets of folding panels or may comprise more than three sets of folding panels, depending upon the configuration desired.

Figure 1:
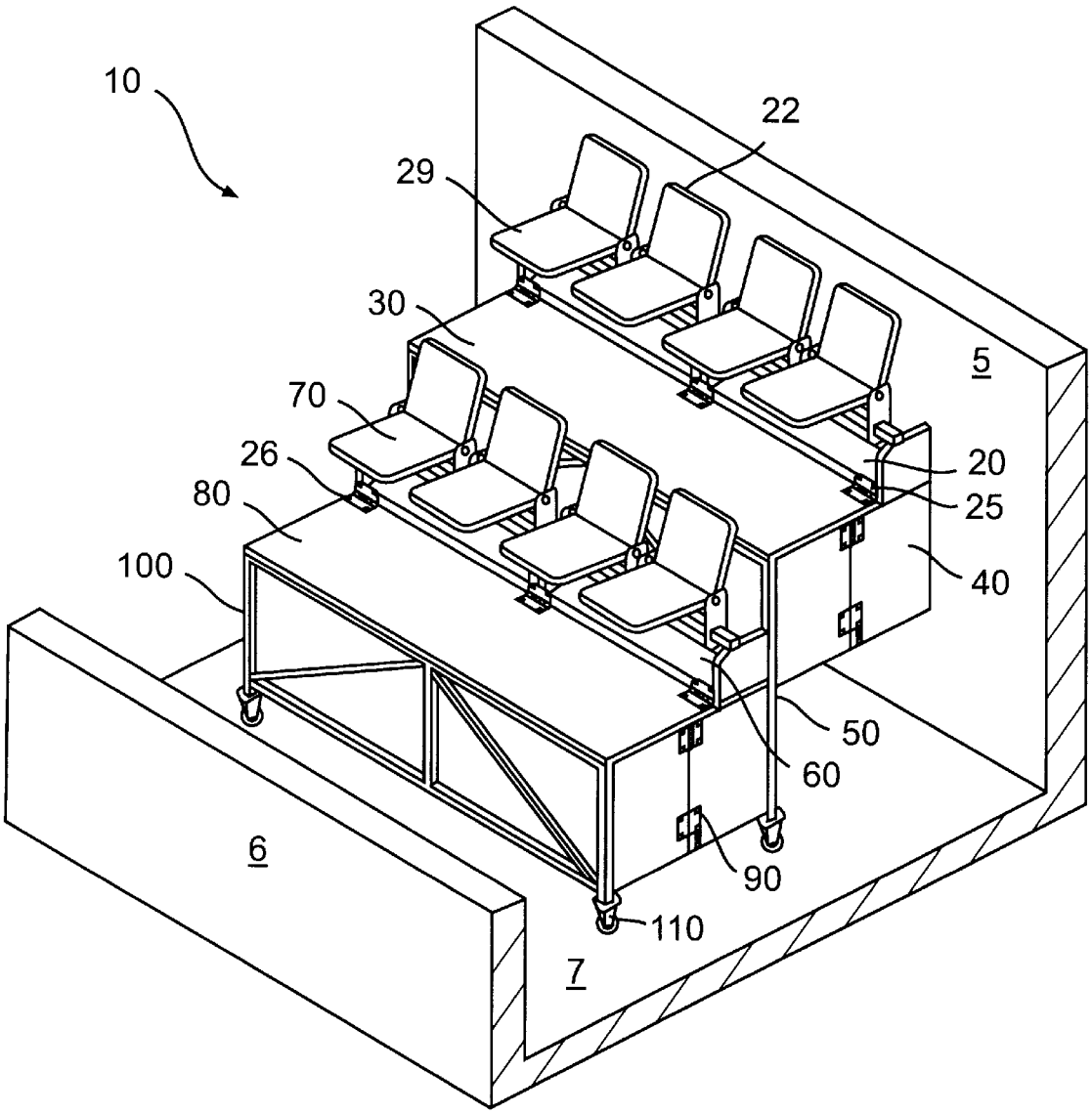
FIG. 1 is a perspective view of the seating system when fully expanded to its open configuration.
Figure 2:
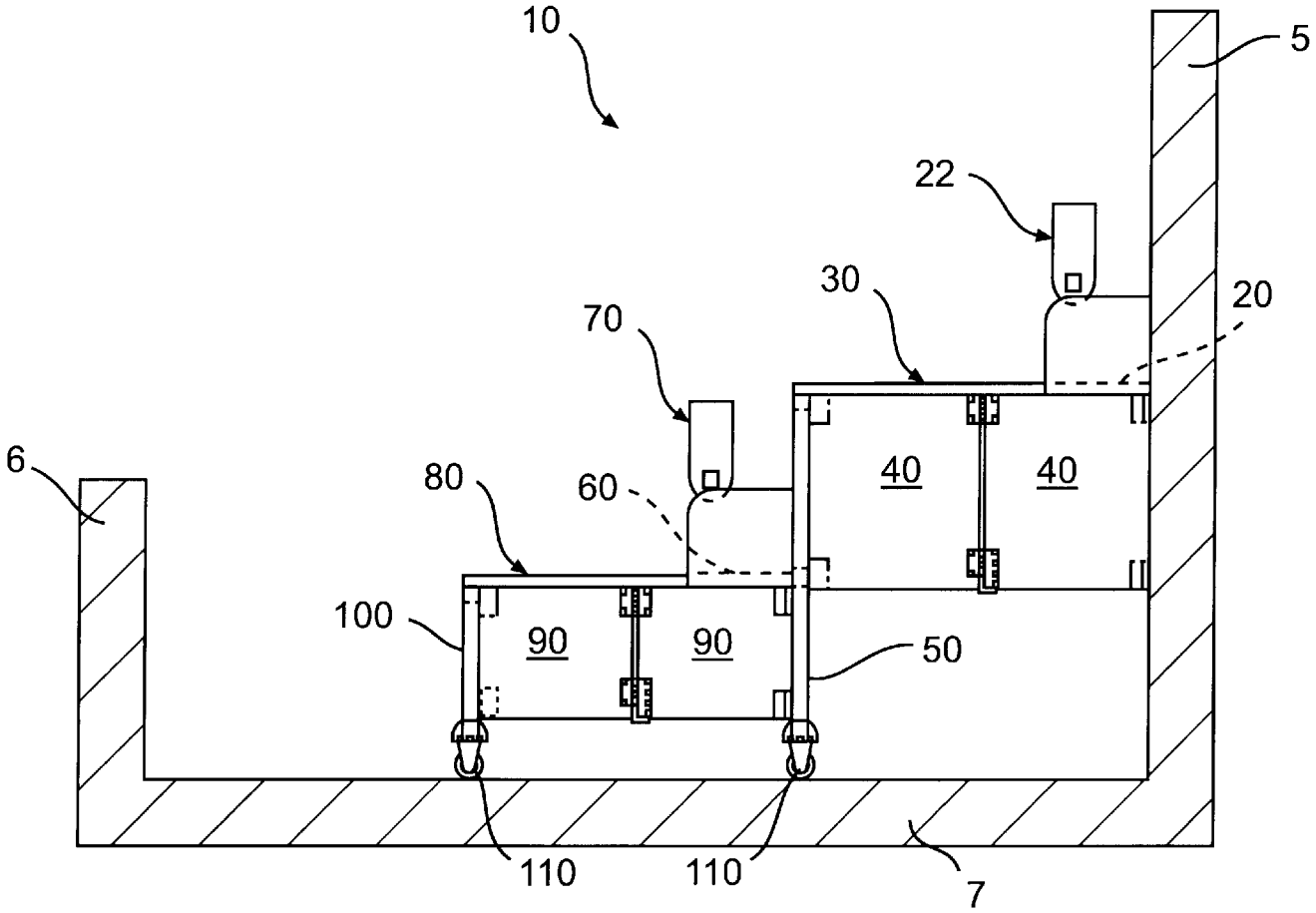
FIG. 2 is a side view of the seating system in its open configuration.

As best shown in FIGS. 1 and 2, a lower platform 60 is affixed to the rear support frame 50. The lower platform 60 resides in a horizontal plane parallel to and below the plane defined by the upper panel 30. Permanently affixed to the lower platform 60 are a lower series of folding seats 70. A lower panel 80 is hingedly connected to the lower platform 60 and, like the upper panel 30, provides a surface for the seats' occupant to place his or her feet when the seat is in use. Residing below the lower platform 60 and the lower panel 80 are a second, lower series of hingedly connected vertical folding panels 90. One end of each hingedly connected panel of the second series of hingedly connected vertical panels 90 is connected to the rear support frame 50 and the other end is connected to a front support frame 100. These panels provide structural support for the lower platform 60 and the lower panel 80. Two sets of the hingedly connected folding panels in the series of hingedly connected vertical panels 90 may be connected by t-bar 42 or by any similar rigid member as shown in FIG. 4. Of course, the series of hingedly connected vertical panels 90 may be comprised of only two sets of folding panels or more than three sets of folding panels, depending upon the configuration desired. The rear and front support frames 50, 100 include casters 110, whose purpose will be described below.

Figure 3:
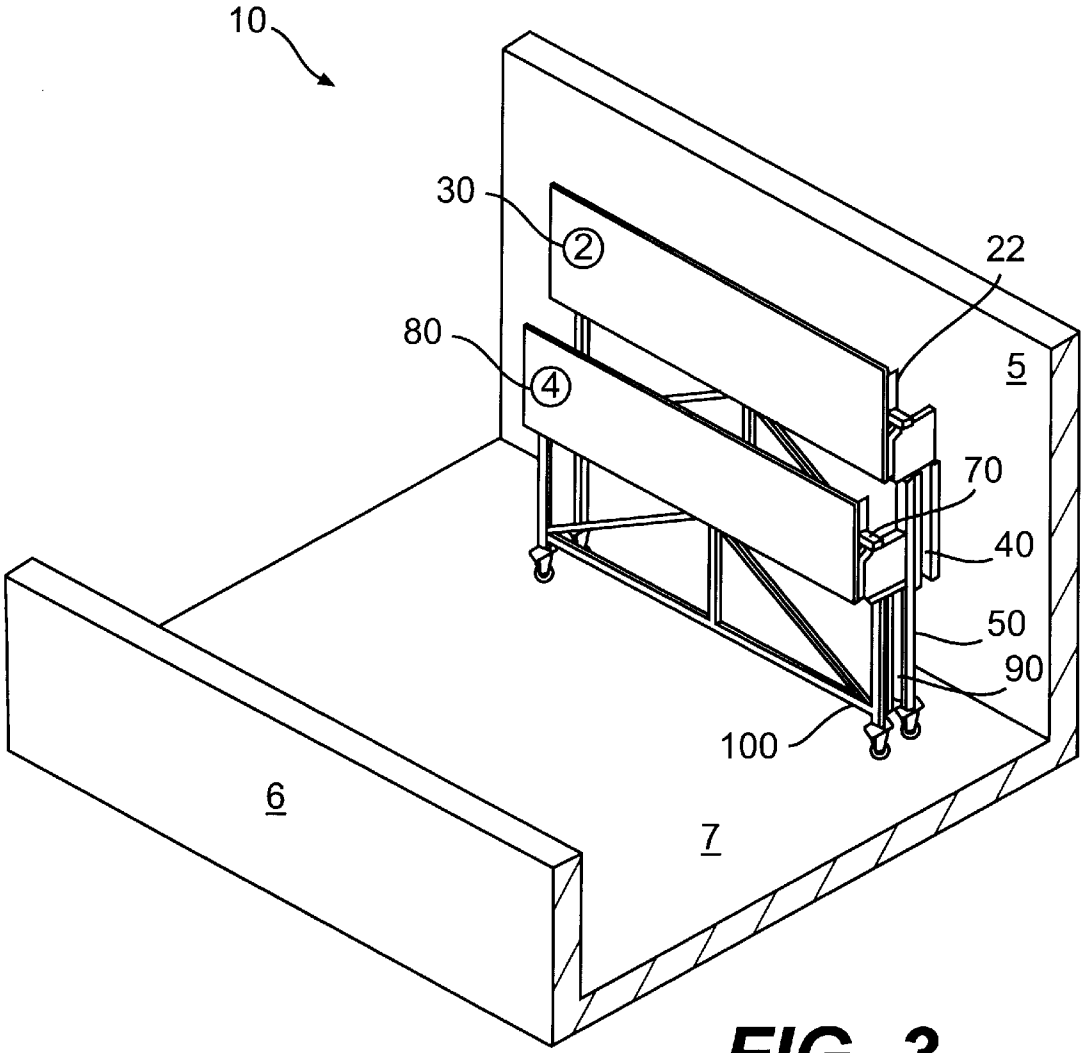
FIG. 3 is a perspective view of the seating system when collapsed to its compact configuration.

In accordance with the invention, the seating system 10 is placed in its compact configuration as follows. The seat portions 24 of the upper and lower series of seats 22, 70 are rotated upward to a substantially vertical, folded position. Next, the upper and lower panels 30, 80 are rotated upward to assume a substantially vertical position, thereby encasing the previously folded upper and lower series of seats 22, 70, as shown in FIG. 3. Thereafter, the upper and lower series of hingedly connected vertical panels 40, 90 are folded inward about their hinged connections. The t-bar 42 spanning between two of the hingedly connected vertical panels

40, 90 facilitates this folding process. As one of the folding vertical panels 40, 90 is pressed inwardly, the t-bar 42 moves laterally with the movement of the vertical panel 40, 90 to which it is connected. Force is transmitted from one vertical panel 40, 90 to the other vertical panel 40, 90 connected to the other end of the t-bar 42, preventing the panels from folding in the wrong direction and adding structural integrity to the seating arrangement. As the vertical panels 40, 90 are being folded, the rear and front support frames 50, 100 move backward toward the rear wall 5 via their casters 110. The support frames 50, 100 may be guided in a linear path by providing the casters 110 with a track affixed to the ground surface (not shown). Alternatively, the seating system 10, once it is placed in its compact configuration, may be easily transported, via the casters 110, to a separate storage location.

Figure 5:
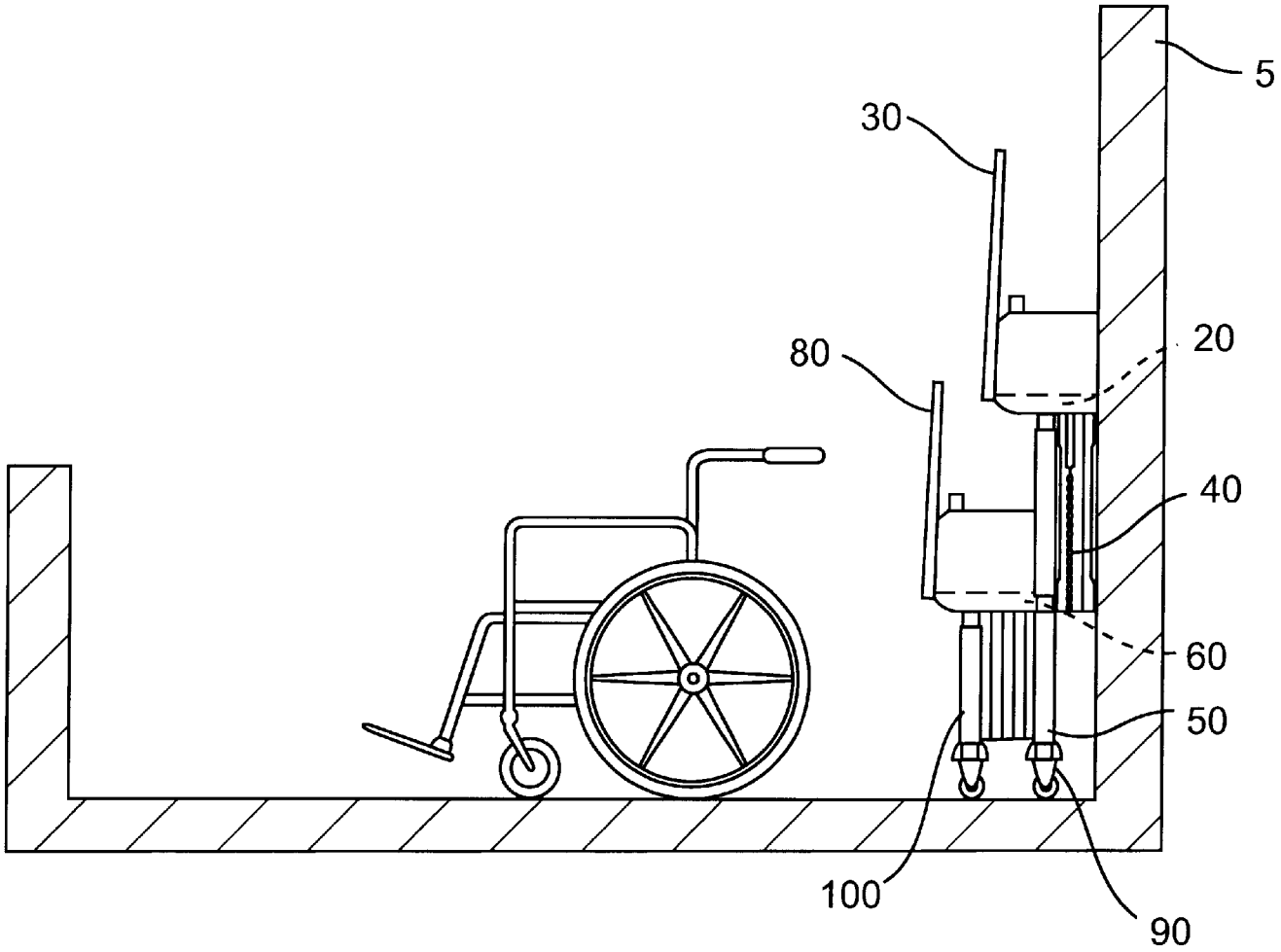
FIG. 5 is a side view a wheelchair in conjunction with the seating system in its compact stored configuration.
Figure 6:
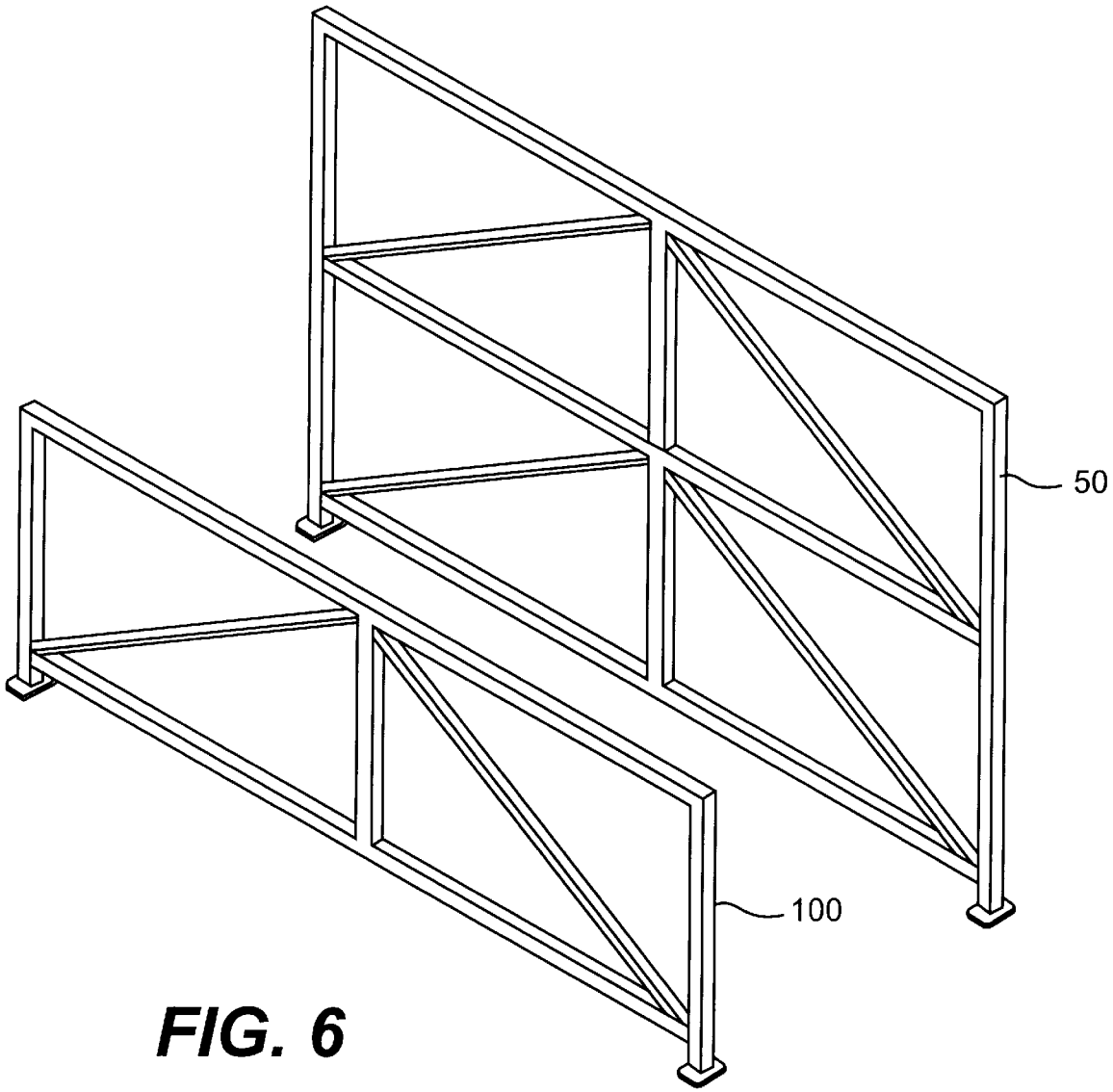
FIG. 6 is a perspective view of front and rear support frames.

The Americans with Disabilities Act requires allocation of a minimum amount of space for each wheelchair in any wheelchair accessible seating area. The seating system 10 of this invention, when folded in its compact configuration, extends to only about 18 inches from the rear wall 5, as depicted in FIG. 5. Of course, depending on the particular configuration of the surrounding area, the seating system 10 may extend more than 18 inches from the rear wall 5. The entire seating system 10 may be folded to within approximately 18 inches once it has been retracted to its stored position as depicted in FIGS. 3, 4, and 5. The orientation of the upper and lower series of hingedly connected vertical panels 40, 90 prevents lateral movement of the rear and front support frames 50, 100 when the seating system 10 is placed into a compact configuration or expanded from its compact configuration.

To allow for ease of folding, and to help insure that the vertical panels 40, 90 rotate about their hinged connections, the upper and/or lower series of hingedly connected vertical panels 40, 90 may be equipped with an elastic cord 120, or any other similar means, which lies in tension between the upper and/or lower series of hingedly connected vertical panels 40, 90 when the seating system 10 is in its opened configuration. As illustrated in FIG. 4, the elastic cord 120 is attached at one end to the hinged connection 125 between one of the panels 40, 90 in the series of hingedly connected vertical panels 40, 90. The other end of the elastic cord 120 may be attached to either the t-bar 42, proximate the location where a centrally located pair of hingedly connected folding panels 40, 90 reside, or to the hinged connection 130 of a neighboring folding panel 40, 90. When the seating system 10 is to be placed in its compact configuration, a release lever (not shown) is turned, thereby allowing the cord in tension 120 to act upon the corresponding hinged panels 40, 90, pulling them toward one another. The rear and front support frames 50, 100 are likewise pulled toward one another and, in turn, toward the rear wall 5. Alternatively, tension means, for example an elastic cord or any material exhibiting similar elastic qualities, may be attached to the rear and front frames 50, 100. When the seating system 10 is in its open configuration, the tension means (not shown) lies in tension between the rear and front frames 50, 100. Similarly, when the seating system 10 is to be placed in its compact configuration, a release lever (not shown) is turned, thereby allowing the cord in tension to act upon the corresponding rear and front frames 50, 100 pulling them toward one another.

It will be apparent to those skilled in the art that various modifications and variations can be made in the embodiments of the present invention without departing from the spirit or scope of the invention. Thus, it is intended that the present invention cover the modifications and variations of this invention provided they come within the scope of the appended claims and their equivalents.

What is claimed:

1. A collapsible seating system, comprising:

a forward seating system extending between front and rear support frames, comprising a lower series of folding seats affixed to a lower platform proximate said rear support frame, a lower panel hingedly connected to said lower platform and extending between said lower platform and said front support frame, and a lower series of vertical folding panels beneath said lower platform and said lower panel, said lower vertical panels being affixed to and spanning between said front and rear support frames, whereby said lower vertical panels fold inward drawing said front frame toward said rear frame; and a rear seating system extending between said rear support frame and a stationary wall, comprising an upper series of folding seats affixed to an upper platform proximate said stationary wall, an upper panel hingedly connected to said upper platform and extending between said upper platform and said rear support frame, and an upper series of vertical folding panels beneath said upper platform and said upper panel, said upper vertical panels being affixed to and spanning between said rear support frame and said stationary wall, whereby said upper vertical panels fold inward drawing said rear frame toward said stationary wall.

2. The seating system according to claim 1, wherein at least two sets of panels of said upper series of vertical folding panels are connected to each other by an elastic cord.

3. The seating system according to claim 1, wherein at least two sets of panels of said lower series of vertical folding panels are connected to each other by an elastic cord.

4. The seating system according to claim 1, wherein at least two sets of panels of said upper series of vertical folding panels are connected by a rigid member.

5. The seating system according to claim 1, wherein at least two sets of panels of said lower series of vertical folding panels are connected by a rigid member.

6. The seating system according to claim 4, wherein said rigid member comprises a t-bar.

7. The seating system according to claim 5, wherein said rigid member comprises a t-bar.

8. The seating system according to claim 1, wherein said front and rear support frames are connected to each other by tension means.

9. The seating system according to claim 8, wherein said tension means comprises an elastic cord.

10. A collapsible seating system comprising:

an upper platform having an upper series of folding seats affixed thereon and an upper panel hingedly connected thereto for supporting the feet of the occupants of said upper series of folding seats, said upper platform and said upper panel extending between a stationary wall and a rear support frame; and an upper series of vertical folding panels beneath said upper platform and said upper panel, said upper series of vertical panels being connected to, and spanning the distance between, said rear support frame and said rear wall, wherein said upper series of folding seats and said upper panel fold upward and said upper series of vertical panels fold inward drawing said rear support frame toward said rear wall to assume a compact configuration;

a lower platform having a lower series of folding seats affixed thereon and having a lower panel hingedly connected thereto for supporting the feet of the occupants of said lower series of folding seats, said lower platform and said lower panel extending between said rear support frame and a front support frame; and a lower series of vertical folding panels beneath said lower platform and said lower panel, said lower series of vertical panels being connected to, and spanning the distance between, said front support frame and said rear support frame, wherein said lower series of folding seats and said lower panel fold upward and said lower series of vertical panels fold inward drawing said front support frame toward said rear support frame to assume a compact configuration.

* * * * *